United States Patent [19]

Ludvigsen

[11] 3,946,881

[45] Mar. 30, 1976

[54] TRANSVERSE TRAVELLING CRANE FOR SHIPS

[75] Inventor: Harald Ludvigsen, Fredrikstad, Norway

[73] Assignee: A/S Fredriksstad mek. Verksted, Fredrikstad, Norway

[22] Filed: Sept. 30, 1974

[21] Appl. No.: 510,859

[52] U.S. Cl. ..... 214/15 R; 212/73; 212/95

[51] Int. Cl.[2] ..... B63B 27/10

[58] Field of Search ..... 214/12, 13, 14, 15 R; 212/73, 75, 95

[56] References Cited

UNITED STATES PATENTS

| | | | |
|---|---|---|---|
| 3,696,947 | 10/1972 | Ponsen | 214/14 |
| 3,722,705 | 3/1973 | Gould | 214/14 X |

*Primary Examiner*—Robert G. Sheridan

*Attorney, Agent, or Firm*—Wenderoth, Lind & Ponack

[57] ABSTRACT

The invention relates to a transverse travelling crane for ships which comprises a fixed horizontal crane beam extending transversely of the ship through a superstructure thereon. The beam has substantially the same length as the width of the ship, and the superstructure is accommodated with access openings on either side thereof. At each end of the fixed beam is an upwardly pivotable cantilever crane beam. In inactive position the cantilever beam or beams are swung up to vertical position along the side of the ship. A winch carriage is adapted for travelling along the crane beams. The carriage is provided with a travelling and hoisting wire system having wires extending out to pulleys located at the respective outer end of each cantilever beam, and these wires run beneath guiding means such as pulleys in the vicinity of the pivoting axes of the cantilevered beams. Thus the wires are operative so that the crane without readjustments can be used with none, one or both cantilever beams in the active position.

5 Claims, 5 Drawing Figures

TRANSVERSE TRAVELLING CRANE FOR SHIPS

BACKGROUND OF THE INVENTION

1. Field of the Invention

The present invention relates to a travelling or transverse crane for sea-going ships of any kind.

The invention relates more particularly to a fixed transverse crane with a travelling winch trolley or carriage, particularly a crane of the auxiliary type for handling small cargo such as ships stores and provisions, machinery parts and equipment, luggage, etc.

An object of the invention is to provide a transverse crane of this type having cantilevered beams extendable outside the ship sides such that cargo can be handled from a position along either side of the ship to various positions below the ship deck.

2. Description of the Prior Art

There are known several types of so-called gantry cranes wherein the crane beam or beams supporting a winch trolley or a travelling carriage are provided with a cantilevered beam or beams extended beyond the supporting posts on the ship. There are also known various types of gantry cranes wherein the horizontally extending carrier beam can be retracted from a cantilevered position, and furthermore there are known cantilevered crane beams which are pivotally connected to the carrier beam mounted on the ship.

Although effective in use such crane constructions present several well known disadvantages. Thus the crane structures are heavy, space consuming and quite expensive. A special problem arises frequently in connection with the total height of the crane structure, impeding the stability of the ship. Furthermore, such cranes to a large extent are exposed to the weather which naturally leads to corrosion and the risk of incidental malfunctions, due to failing bearings, cables and/or control equipment, etc.

OBJECTS OF THE INVENTION

The main object of the present invention is to provide a transverse crane which can be built of a relatively light construction, which is correspondingly simple to install and which takes up comparatively little space on the ship. A further aim is to provide a construction wherein two cantilevered parts of the carrier beam for the winch trolley in a simple and quick manner can be retracted to a flush position with the sides of the ship without impeding the operation of the crane.

A particular object of the invention is to provide a travelling transverse crane which can be adapted for installation on a normal accommodation deck height and therefore can be installed, partly internally, in or in connection with the forward wall of a ship casing, superstructure or other erections.

A special object of the invention is to provide a travelling crane wherein the operating equipment for the crane, such as the winch trolley, controls, etc. can be mounted and partly positioned in closed position in a closure on the ship.

SUMMARY OF THE INVENTION

The transverse crane in accordance with the invention essentially includes a fixed horizontal crane beam extending transversely of the ship through a superstructure thereon and having substantially the same length as the width of the ship, the superstructure being accommodated with access openings on either side thereon, at each end of the fixed beam an upwardly pivotable cantilever crane beam, a winch carriage adapted for travelling along the crane beams, the winch carriage being provided with a travelling and hoisting wire system having wires extending out to pulleys located at the respective outer end of each cantilever beam, such wires running beneath guiding means such as pulleys in the vicinity of the pivoting axes of the cantilevered beams. The travserse crane can thereby, without re-adjustments, operate with the one or the other or both cantilever beams in the inoperative, retracted position.

The transverse crane in accordance with the invention also possesses other important advantages. Such advantages includes the special deck space saving positioning of the crane, and the fact that it is possible to use one or both cantilever beams simultaneously handling goods from either side of the ship and bringing the goods directly down to desired level in the ship through doors or access openings in the ship superstructure walls below the crane beam, thus making it unnecessary to use the usual deck hatches or similar accesses. Other advantages include simplicity of construction and maintainance, and furthermore improved safety in that no hatches are required, but only door openings, which inherently are safer.

BRIEF DISCRIPTION OF THE DRAWINGS

An embodiment of a tranverse crane in accordance with the invention shall in the following be further described in connection with the accompanying drawings, wherein.

DETAILED DESCRIPTION OF THE INVENTION

Figures 1, 2, 3:
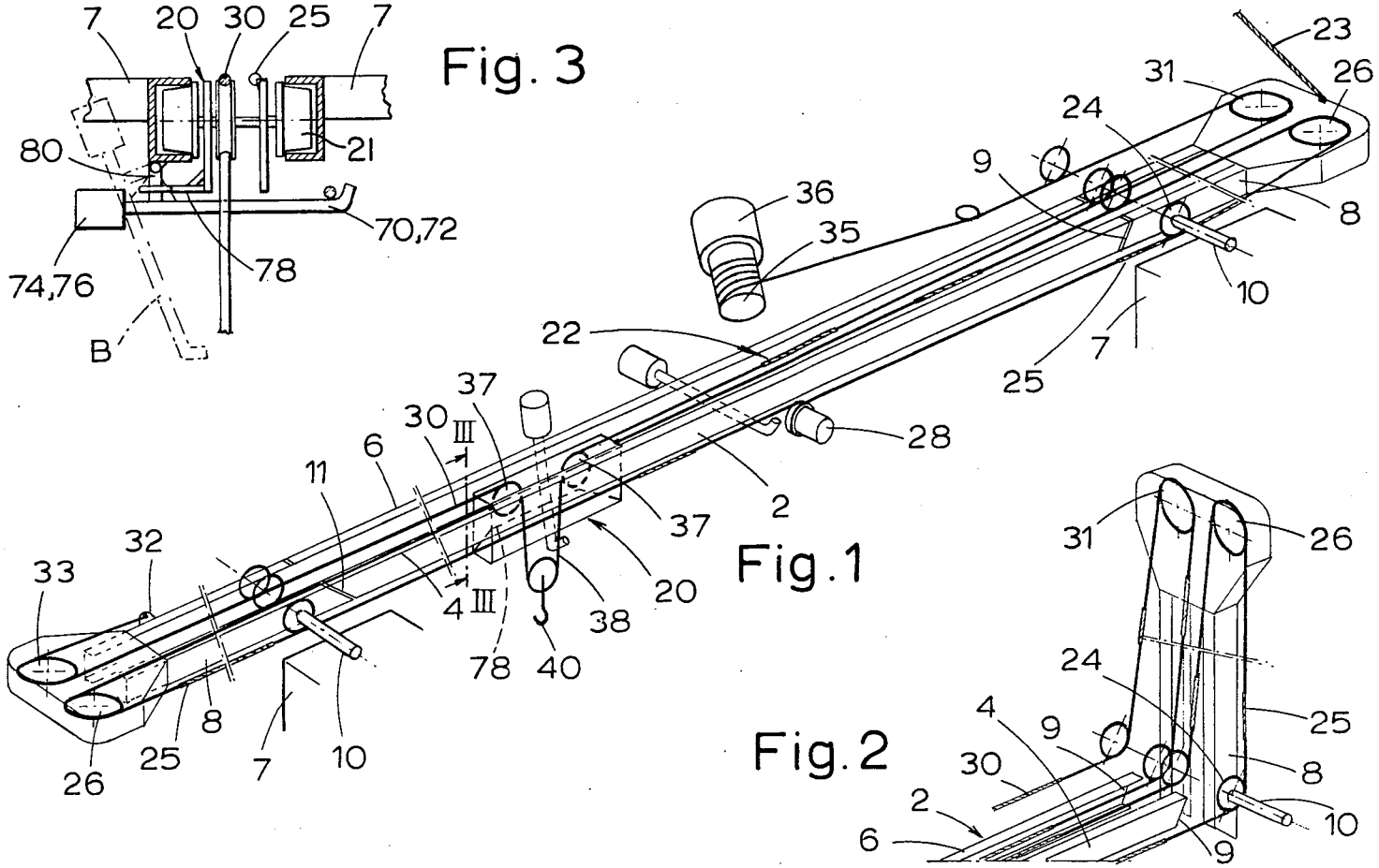
FIG. 1 is a schematic perspective view of the assembled crane, both cantilever beams being in operative position.
FIG. 2 is a detail perspective view similar to FIG. 1, and showing one of the cantilever beams in raised position.
FIG. 3 is a detail sectional view shown in an enlarged scale taken along the III—III of FIG. 1.

In FIGS. 1, 2 and 3 the reference number 1 designates a crane carrier beam which in the illustrated embodiment comprises two parallel U-beam sections 4 and 6, which are installed and supported by an adjacent supporting structure in the casing, and which in the Figures for sake of clarity, are only indicated in the shape of two supporting parts 7. At each end 9, 11 of the fixed beam section 4, 6, respectively, are provided extensions or cantilever beams 8, which are pivotally journalled on horizontal pivot shafts 10, which are supported in the superstructures 7. The cantilever beams are arranged to be pivotable upwards from the horizontally extended position shown in FIG. 1 to a vertical inoperative position as shown in FIG. 2. The abutting meeting ends of the carrier beam 2 and the cantilever beams 8, are made complementary to each other, preferably undercut as illustrated, in order to provide a steady and firm bias for the cantilever beams when they are lowered down to the operative horizontal position. It should be understood that FIGS. 1 and 2 only are meant to illustrate the principle of the crane construction. In a practical embodiment the pivotal cantilevered beams would preferably be arranged with further biasing and locking means. Each of the cantilever beams 8 is suspended by a suspension wire 23 (only one shown) which at a higher level on the superstructure is connected to a motor means such as a hydraulic winch or the like, see elements 62 and 63 in FIG. 4.

The important feature is, however, that when one or both cantilever beams 8 are positioned in horizontal, cantilevered position, they will, together with the crane beam 2, provide a continuous support for a winch carriage 20.

The winch carriage 20 is provided with rollers 21, for instance four pairs of rollers. The carriage is preferably driven by means of a wire hauling system 22 having a hauling wire or cable 25 running underneath pulleys 24, at each end of the beam 2, which pulleys 24 are preferably journalled somewhat excentrically relative to the pivots 10 of the cantilever beams 8 such as schematically illustrated in FIGS. 1 and 2. For sake of clarity the wires are partly shown as one thick line, partly as a double-lined wire. The wire 25 extends further out to turning pulleys 26, supported at the outer ends of the cantilever beams 8. The respective ends of the hauling wire 25 are in conventional manner anchored to the winch carriage 20. Thereby the carriage 20 can, independently of the angular position of one or both cantilever beams 8, travel on the fixed crane beam 2 by means of operation of a motor 28 which can be installed at a suitable position below the beam 2 inside the ship superstructure or casing. In the operational position of the crane as illustrated in FIG. 1, the winch carriage 20 can furthermore be directly driven out to the outer end of each of the cantilever beams 8. When one or both cantilever beams 8 are positioned in raised inoperative position as illustrated in FIG. 2, the winch carriage would at arrival thereto bump against the cantilever beam 8 and thereby be brought to a halt.

The carriage 20 is furthermore provided with a hoisting wire 30, one end of which is anchored to one of the cantilever beams 8 at an anchor point 32 via a running pulley 33 outermost on this beam. The other end section of the hoisting wire 30 likewise extends around a running pulley 31 on the other cantilever beam 8 and from there to a winch drum 35 including a winch motor 36. From the carriage 20 the hoisting wire 30 is, via suitable pulleys 37 arranged with a wire sling 38 and in conventional manner provided with a hook means 40. At the fixing point 32 for the hoisting wire 30 is preferably provided a further running wheel, from which the wire 30 can be extended to an auxiliary hoisting drum, serving as an emergency hoisting means to be used if the motor 36 should fail. (These parts not shown).

In place of the preferred described hoisting wire system 30 including a stationary mounted winch motor/drum 35, 36 (inside the superstructure), there could be provided embodiments wherein the winch carriage is provided with suitable electrically or hydraulically driven motor means for the hoisting wire 30.

It will be appreciated that the various wire runs in the hauling and hoisting wire system will, if not exceedingly tensioned, have a tendency to hang down and form slack portions along the runs between the respective pulleys on the carrier and on the crane beams and the cantilevered beams, respectively. Such slack wire portions are not only inconvenient, but may cause incidental derailing or jump off of a wire. To overcome this problem the wires are, as best shown in FIG. 3, along their runs intermittently supported by weight supported pivotal arms 70, 72, etc. having counterweights 74, 76 sufficient to keep the arms horizontal as shown in order to support the wires 25 and 30. A cam plate 78 mounted on the carriage 20 will, during travel of carriage 20, hit arm brackets 80 and pivot the arms to a side position B as shown by dashed lines in FIG. 3 thereby allowing free passage of the carriage and the hoisting wire loop 38, etc. When the carriage has passed the bracket 80 on an arm 70, the arm will again drop down and support the wires, whereby slack 1 portions will be avoided. In order to avoid noise the cam plate 78 and the adjacent part of the arms 70, 72 can be rubber clad.

Figure 4:
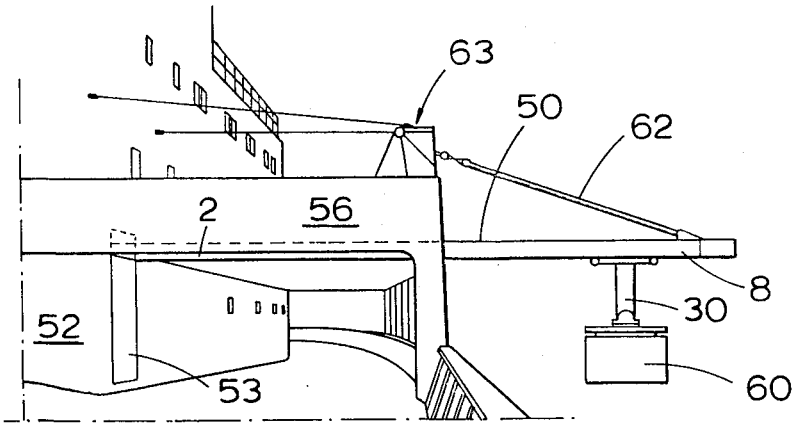
FIGS. 4 and 5 are fragmentary views perspectively showing parts of a ship with a superstructure and illustrating the installation of a transverse crane in accordance with the invention.
Figure 5:
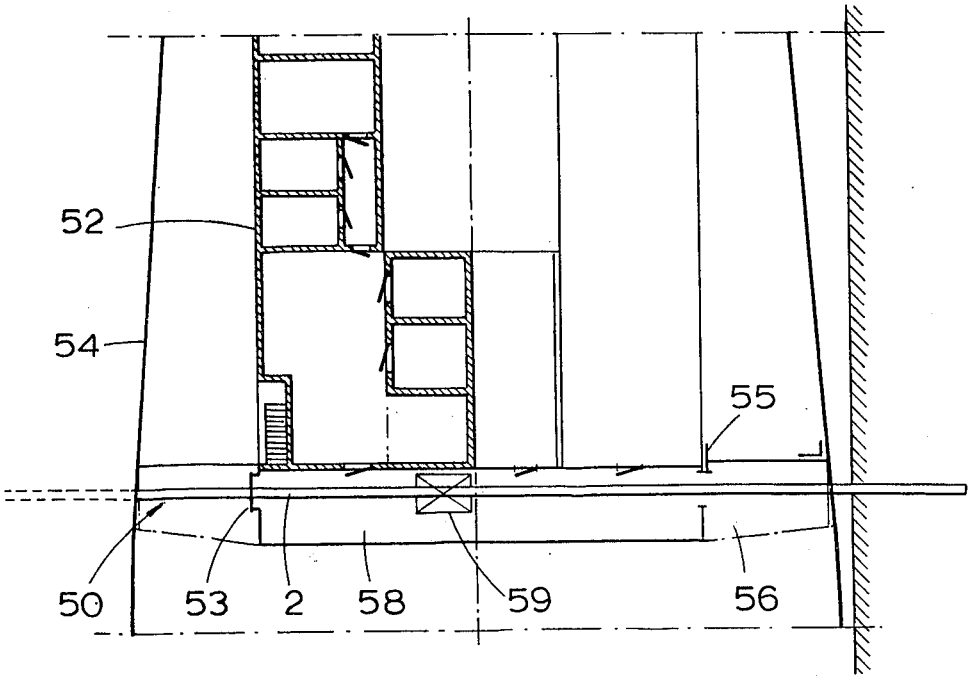

FIGS. 4 and 5 illustrate schematically a typical installation of a transverse crane in accordance with the invention mounted aboard a sea-going ship, having a casing or superstructure 56.

The transverse crane 50 is herein shown mounted below the ceiling or roofing at the fore edge of the deck casing 52, such that the crane beam 2 extends out to the side of the hull below the casing deck. In the casing 52 the beam 2 extends through a transverse crane shaft or passage 58 which suitably is provided with doors 53 at both sides of the casing 52. From the crane shaft 58 extends downwardly preferably at the centre of the ship a vertical shaft 59 providing direct access to the various levels in the ship. The crane motor 35, 36 and the hauling wire motor 28 are suitably mounted positions along the crane passage 58 which are easily accessible. The crane is furthermore furnished with complete control means including switches etc. on both sides of the ship, thus making it possible for an operator to operate the crane from either side of the ship. FIG. 4 illustrates the crane in operation. The cantilever beam 8 is here swung down to the horizontal operating position, and is supported by a hoisting cable 62 at the upper end connected to a hoisting and storing outfit 63. A piece of goods 60 is supported by the hoisting wire 30 and can from the illustrated position be driven into the ship through the access door 53 to the center of the casing 52 and down through the hatch 59 to a desired deck level in the ship.

Usually only one of the cantilever beams 8 will be used at a time. It will, however, be understood that a transverse crane in accordance with the invention can be utilized with both cantilever beams in operation, for instance for handling cargo to/from both sides of the ship or from one side to the other. Furthermore, the crane can be used for internal handling of goods as an elevator crane between various deck levels in the ship.

A substantial advantage of the above construction rests in the fact that the crane requires little space and forms little or no obstruction. Conventional cranes usually form obstructions for traffic and otherwise aboard the ship, and furthermore require special hatches etc. for providing access to the inside of the ship. Further, in accordance with the invention, no adjustments are necessary for using one or the other of the cantilever beams, and the motors etc. for the crane are mounted on the inside of the casing and thus are protected against the weather.

I claim:

1. In a ship of the type including a main deck, deck railing, a superstructure, and a transverse travelling crane mounted above said deck, improvement comprising:

a crane passage extending transversely through said superstructure at a level above said deck;

access openings into said superstructure, on opposite sides thereof at positions below said crane passage;

said transverse travelling crane comprising:

a horizontal crane boom extending through said crane passage and fixed to said superstructure, said fixed crane boom having opposite ends thereof positioned above said railing at opposite sides of said ship;

a pair of cantilever crane booms, one each pivotally supported at respective of said opposite ends of said fixed crane boom, each of said cantilever crane boom being upwardly pivotable from a substantially horizontal operative position forming a horizontal extension of said fixed crane boom;

a load carrying and hoisting carriage mounted for travel along said fixed crane boom, said carriage being movable along said cantilever crane booms when said cantilever crane booms are in said operative positions thereof;

carriage movement means for moving said carriage along said fixed crane boom and said cantilever crane booms and including turning pulleys positioned on the respective outer extremities of said cantilever crane booms, guide pulleys positioned adjacent respective pivot axes of said cantilever crane booms, and a cable connected to said carriage and extending around said turning pulleys and under said guide pulleys.

2. The improvement claimed in claim 1, further comprising at least one bar pivotally mounted along the length of said crane and bearing against said cable to prevent slack therein; cam means on said carriage positioned upon movement of said carriage for contacting said bar and pivoting said bar out of the path of said carriage; and weighting means on said bar for pivoting said bar back into contact with said cable after passage of said carriage.

3. The improvement claimed in claim 1, further comprising a vertical passage within said superstructure, said vertical passage extending downwardly from said crane passage to additional deck levels in said ship.

4. The improvement claimed in claim 1, further comprising means for selectively pivoting said cantilever crane booms upwardly from said operative positions to inoperative positions substantially flush with opposite sides of said ship.

5. The improvement claimed in claim 1, wherein said guide pulleys are mounted eccentrically with respect to said respective pivot axes, thereby comprising means for compensating for variation in cable tension at varying angular positions of said cantilever crane booms.

* * * * *